US007657972B2

(12) United States Patent
Jenkins

(10) Patent No.: US 7,657,972 B2
(45) Date of Patent: Feb. 9, 2010

(54) HANDLE ATTACHMENT ASSEMBLY

(76) Inventor: Graeme Reid Jenkins, 218 Flatbush School Road, Papatoetoe, Auckland (NZ)

( * ) Notice: Subject to any disclaimer, the term of this patent is extended or adjusted under 35 U.S.C. 154(b) by 61 days.

(21) Appl. No.: 11/506,900

(22) Filed: Aug. 21, 2006

(65) Prior Publication Data

US 2008/0040892 A1 Feb. 21, 2008

(51) Int. Cl.
*B25G 1/00* (2006.01)

(52) U.S. Cl. ..... 16/426; 16/106; 16/108

(58) Field of Classification Search ..... 16/406, 16/421, 422, 426, 430
See application file for complete search history.

(56) References Cited

U.S. PATENT DOCUMENTS

| | | | | | |
|---|---|---|---|---|---|
| 237,891 | A | * | 2/1881 | Musselman | 16/426 |
| 1,832,536 | A | * | 11/1931 | Dunn | 403/229 |
| 2,716,274 | A | * | 8/1955 | Smith | 29/280 |
| 3,107,937 | A | * | 10/1963 | Duppengiesser | 294/57 |
| 3,155,414 | A | * | 11/1964 | Bales | 294/58 |
| 3,686,129 | A | * | 8/1972 | Loucks | 510/267 |
| 4,063,701 | A | * | 12/1977 | Wray | 248/292.14 |
| 4,087,225 | A | * | 5/1978 | Wolcott | 425/392 |
| 4,155,582 | A | * | 5/1979 | Reisner | 294/58 |
| 4,197,764 | A | * | 4/1980 | Auernhammer | 74/544 |
| 4,231,611 | A | * | 11/1980 | Bird | 297/215.15 |
| 4,495,669 | A | | 1/1985 | Hooper | |
| 4,794,667 | A | | 1/1989 | Nelson et al. | |
| 4,822,087 | A | * | 4/1989 | DeCarlo | 294/1.1 |
| 5,054,830 | A | * | 10/1991 | Nisenbaum | 294/58 |
| 5,251,380 | A | * | 10/1993 | Craig | 30/329 |
| 5,352,060 | A | | 10/1994 | Poetker | |
| 5,496,085 | A | | 3/1996 | Middleton | |
| D417,382 | S | | 12/1999 | Saladino, Jr. | |
| 6,131,972 | A | * | 10/2000 | Whitehead et al. | 294/57 |
| 6,618,905 | B2 | * | 9/2003 | Warashina et al. | 16/426 |
| 7,052,052 | B2 | * | 5/2006 | Protas et al. | 285/420 |

(Continued)

FOREIGN PATENT DOCUMENTS

| | | |
|---|---|---|
| GB | 2 397 042 | 7/2004 |
| WO | WO 03/037061 | 5/2003 |

OTHER PUBLICATIONS

Stout's Backsaver Grip, www.mercantilebuyers.com.
Back Saving Handle, http://www.crutches.net/backsavin.htm.
Multi-Star Tool Handles—Auxilary Handle, https://www.omygarden.com/index.php?menu=15&itemid=75.

*Primary Examiner*—Victor Batson
*Assistant Examiner*—Roberta Delisle
(74) *Attorney, Agent, or Firm*—Young & Thompson

(57) ABSTRACT

One embodiment of a handle attachment assembly formed in accordance with the present invention is provided. The handle attachment assembly may be used for removably attaching a handle to an elongate shaft having a proximal end and a distal end. The handle attachment assembly may include a hand grip adapted to be gripped and held by a user and a clamp assembly. The clamp assembly may be coupled to the hand grip for removably attaching the hand grip to the elongate shaft between the proximal end and the distal end of the elongate shaft. The clamp assembly may include a first V-shaped clamp and a second V-shaped clamp. A fastening assembly may be used for driving the first V-shaped clamp toward the second V-shaped clamp to removably clamp the elongate shaft between the first and second V-shaped clamps.

20 Claims, 4 Drawing Sheets

U.S. PATENT DOCUMENTS

2002/0104193 A1* 8/2002 Warashina et al. ..... 16/422
2003/0051315 A1 3/2003 Lau
2003/0057721 A1 3/2003 Ducklow
2003/0229966 A1* 12/2003 Boice ..... 16/110.1
2004/0055099 A1 3/2004 Greenberg
2004/0083579 A1 5/2004 Furr-Britt et al.
2004/0178632 A1* 9/2004 Protas et al. ..... 285/419
2004/0251386 A1* 12/2004 Mizukoshi et al. ..... 248/68.1

* cited by examiner

HANDLE ATTACHMENT ASSEMBLY

FIELD OF THE INVENTION

The illustrated embodiment of the present invention relates generally to handle attachment assemblies, and more specifically to handle attachment assemblies for attaching a handle to a shaft.

BACKGROUND OF THE INVENTION

Many tools currently on the market are composed of an elongate shaft that is connected to a working device or implement. A few suitable examples of these sorts of tools are shovels, mops, paint rollers, rakes, and hoes. As one example of use, an operator pushes the implement, such as a shovel head, into the ground by gripping the elongate shaft at the top end with one hand while gripping the elongate shaft in the middle with the other hand and thrusting the shovel head into the ground with the operator's foot. The operator then pivots the elongate shaft backwards to load the shovel head with soil. The user then pulls upwardly on the elongate shaft with their lower-positioned hand and tosses the accumulated material to a desired location. This activity exerts considerable strain on the operator's back and shoulders, due largely to the fact that the operator must repeatedly bend over, grip the middle section of the elongate shaft and stand up straight as the operator pulls upwardly on the shaft to lift and toss the accumulated material from the shovel head.

Thus, there exists a need for a handle attachment assembly that reduces the need to bend while performing a variety of tasks when using tools with elongate shafts both indoors or out. Further, there exists a need for a handle attachment assembly that is adaptable for use with a wide variety of different diameters of shafts and which attaches to the elongate shafts with a high degree of holding power.

OBJECT OF THE INVENTION

It is an object of the invention to provide a handle attachment assembly that ameliorates some of the disadvantages and limitations of the known art or at least provides the public with a useful choice.

SUMMARY OF THE INVENTION

One embodiment of a handle attachment assembly formed in accordance with the present invention is provided. The handle attachment assembly may be used for removably attaching a handle to an elongate shaft having a proximal end and a distal end. The handle attachment assembly may include a hand grip adapted to be gripped and held by a user and a clamp assembly. The clamp assembly may be coupled to the hand grip for removably attaching the hand grip to the elongate shaft between the proximal end and the distal end of the elongate shaft. The clamp assembly may include a first V-shaped clamp and a second V-shaped clamp. A fastening assembly may be used for driving the first V-shaped clamp toward the second V-shaped clamp to removably clamp the elongate shaft between the first and second V-shaped clamps.

BRIEF DESCRIPTION OF THE DRAWINGS

The invention will now be described, by way of example only, by reference to the accompanying drawings.

DETAILED DESCRIPTION OF THE PREFERRED EMBODIMENT

The following description will describe the invention in relation to a preferred embodiment of the invention, namely a handle attachment assembly. The invention is in no way limited to this preferred embodiment as it is used purely to exemplify the invention only and possible variations and modifications are readily apparent without departing from the scope of the invention.

Figure 1:
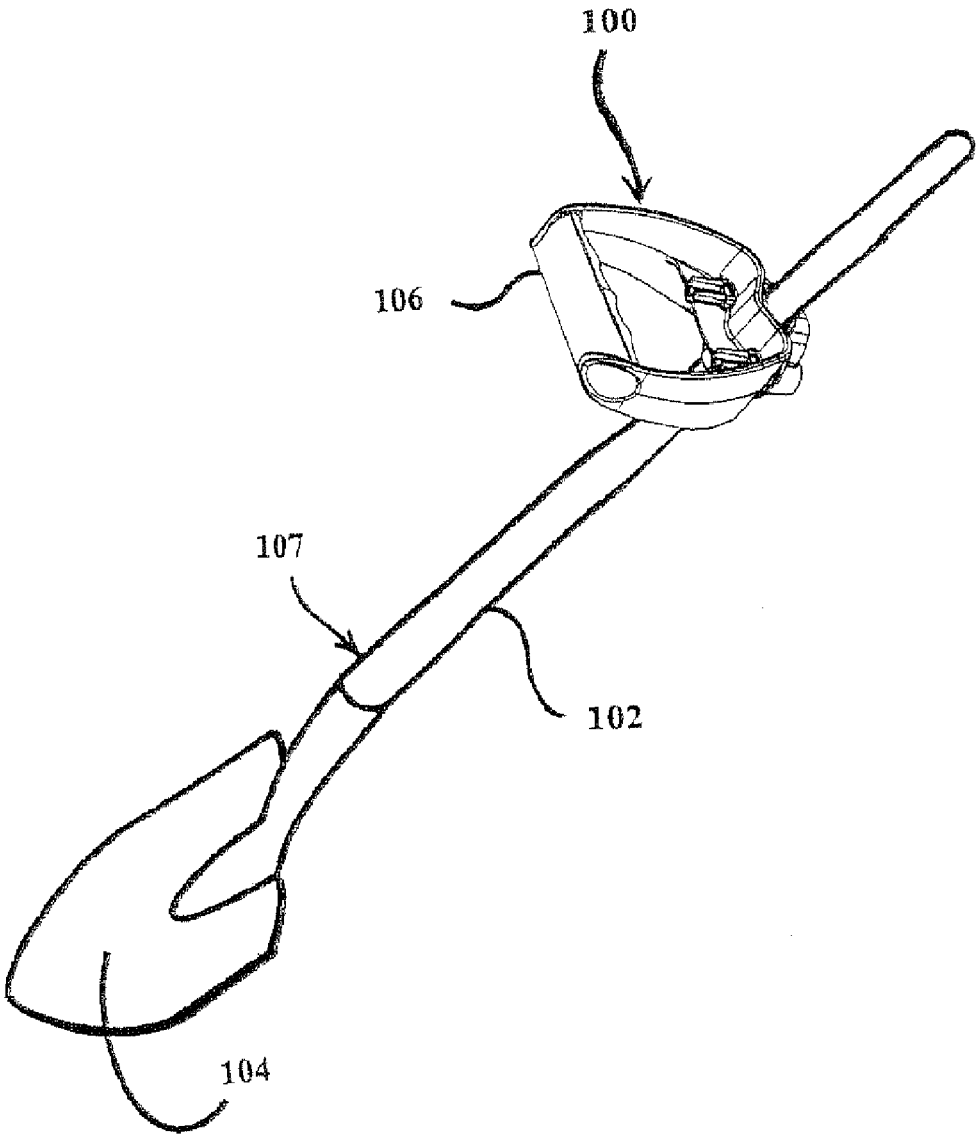
FIG. 1 is an isometric view of one embodiment of a handle attachment assembly formed in accordance with the present invention wherein the handle attachment assembly is shown coupled to a shovel for illustrative purposes.

Referring to FIG. 1, one embodiment of a handle attachment assembly 100 formed in accordance with the present invention is shown. Generally described, the handle attachment assembly 100 permits a hand grip 106 to be attached to any elongate shaft 102 to facilitate the user gripping the elongate shaft 102. Most commonly, the elongate shaft 102 is attached to an implement 104 of a tool 107, a few suitable examples of implements being the shovel head (as shown), a mop head, a paint roller, a rake, a cutting device, and a hoe. Alternately, the elongate shaft 102 may not be attached to an implement 104, such as when the elongate shaft 102 is a railing or a safety bar.

When attached to the elongate shaft 102 of a tool 107, the handle attachment assembly 100 alters the user's handholds on the elongate shaft 102 making the operation of the implement 104 connected to the end of the shaft more efficient through repositioning the user's leverage and lifting points. Using the handle attachment assembly 100 often automatically improves the posture of a user of the tool 107 as a result of the increased leverage available and the higher lifting point supplied by the hand grip 106 of the handle attachment assembly 106. Typically the user will find they are not bent over, their posture is more upright, and less fatigue is experience as less energy is exerted to do jobs previously regarded as strenuous.

Although the handle attachment assembly 100 may be attached anywhere along the length of the elongate shaft 102, preferably, the handle attachment assembly 100 is attached to the elongate shaft 102 of the tool 107 approximately ⅔of the length of the elongate shaft 102 up from the implement 104. Inasmuch as the handle attachment assembly 100 is removably attached to the elongate shaft 102, the position of the handle attachment assembly 100 along the length of the elongate shaft 102 may be adjusted as necessary to provide optimum comfort and performance. Further, since the handle attachment assembly 100 is removably attached to the elongate shaft 102, the orientation of the handle attachment assembly 100 relative to the implement 104 may be adjusted by rotating the handle attachment assembly 100 about the elongate shaft 102 to the desired orientation relative to the implement 104 and locking in place.

Figure 2:
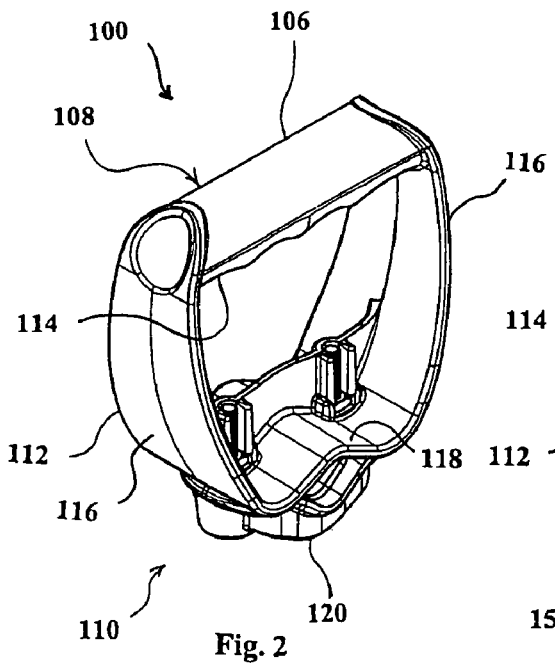
FIG. 2 is an isometric view of the handle attachment assembly of FIG. 1.
Figure 3:
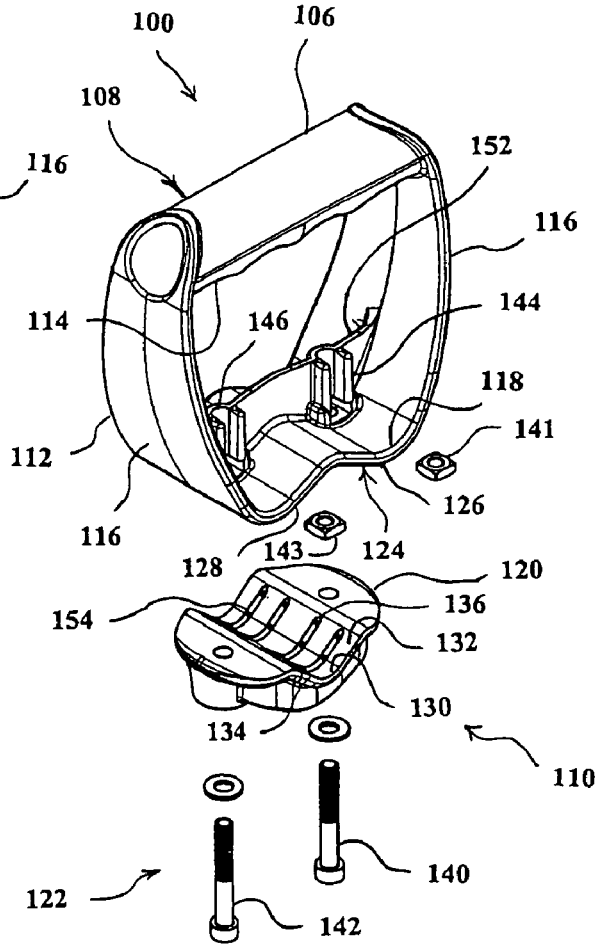
FIG. 3 is an exploded isometric view of the handle attachment assembly of FIG. 2.
Figure 5:
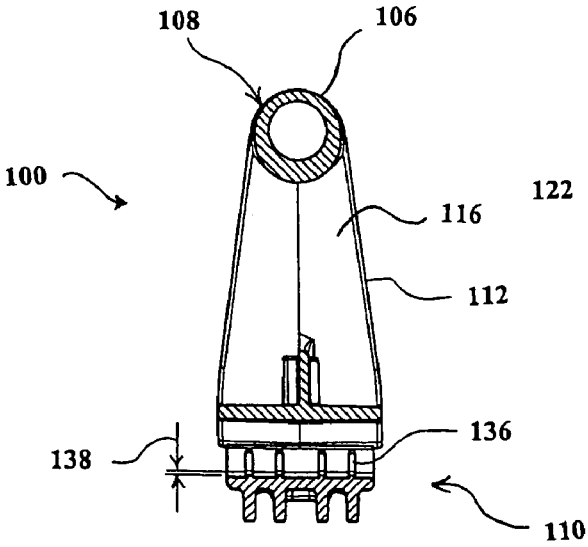
FIG. 5 is a cross-sectional view of the handle attachment assembly of FIG. 4, the cross-sectional cut taken substantially through Section A-A of FIG. 4.
Figure 6:
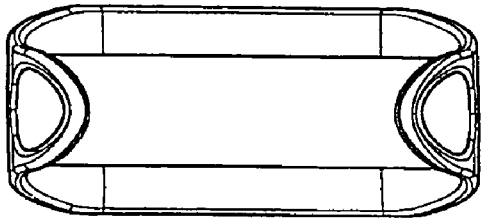
FIG. 6 is a top view of the handle attachment assembly of FIG. 4.

Referring now to FIGS. 2, 3, and 5, the structure of the handle attachment assembly 100 will now be described in greater detail. The handle attachment assembly 100 includes a hand grip assembly 108 for facilitating a user gripping the handle attachment assembly 100 and a clamp assembly 110 for removably attaching the handle attachment assembly 100 to the elongate shaft 102.

The hand grip assembly 108 includes the hand grip 106 and a grip support frame 112. The hand grip 106 is adapted to be easily and comfortably gripped by a user's hand. The hand grip 106 is preferably greater than two centimeters in diameter, and most preferably greater than about 2.54 centimeters in diameter. The hand grip 106 may include a plurality (preferably four) of finger indentations 114 (best shown in FIG. 4) each adapted to receive a finger of the user when gripping the hand grip 106.

The grip support frame 112 includes a pair of support arms 116 coupled to each end of the hand grip 106. The support arms 116 are preferably rigidly and non-removably coupled to the hand grip 106 at one end and to the clamp assembly 110 at their other ends. The support arms 116 are preferably of sufficient length to place the hand grip 106 greater than 15 centimeters outward from the elongate shaft when the handle attachment assembly 100 is coupled to the elongate shaft 102. Further still, preferably the support arms 116 are coupled to the clamp assembly 110 such that the length of the hand grip 106 is oriented perpendicular to the length of the elongate shaft 102, however it should be noted that the hand grip 106 may be mounted in any orientation relative to the clamp assembly 110 without departing from the spirit and scope of the present invention. Further, the hand grip 106 may be adjustably coupled to the clamp assembly 110, such that the orientation relative to and/or the distance of the hand grip 106 from the elongate shaft may be adjusted.

The clamp assembly 110 permits the hand grip assembly 108 to be removably attached to the elongate shaft 102 between the proximal and distal ends of the elongate shaft. The clamp assembly 110 may be comprised of a first V-shaped clamp 118, a second V-shaped clamp 120, and a fastening assembly 122 for driving the first V-shaped clamp 118 toward the second V-shaped clamp 120 to removably clamp the elongate shaft between the V-shaped clamps 118 and 120.

Figure 9:
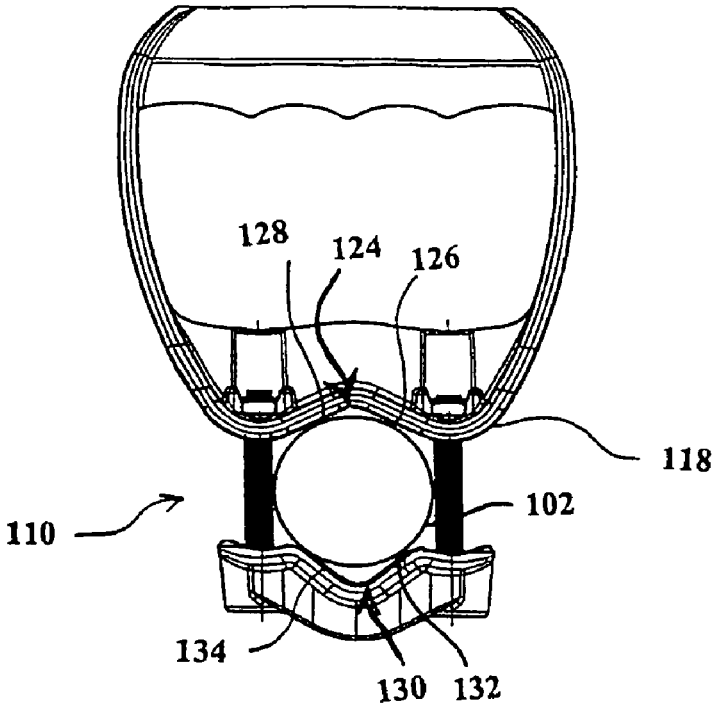
FIG. 9 is a front elevation view of the handle attachment assembly of FIG. 4 showing the handle attachment assembly removably coupled to a large diameter elongate shaft.

The first V-shaped clamp 118 is preferably integrally formed with the hand grip assembly 108, and more specifically, is preferably rigidly attached to one of the ends of each of the support arms 116. Turning to FIGS. 3 and 9, the first V-shaped clamp 118 includes a clamping surface 124 for engaging the elongate shaft 102. Although the clamping surface 124 may be semi-circular in shape to correspond to the shape of the elongate shaft 102, it is preferred that the clamping surface 124 be a V-shaped clamping surface 124 as shown having a first substantially planar clamping surface 126 inclined relative to a second substantially planar clamping surface 128 by a predetermined angle. The predetermined angle may be any angle, but is preferably greater than 90 degrees and less than 180 degrees, and is most preferably greater than about 110 degrees. In the illustrated embodiment, the predetermined angle is about 135 degrees.

The second V-shaped clamp 120 is preferably a free floating part relative to the hand grip assembly 108, and more specifically, is preferably adjustably coupled to the hand grip assembly 108 by the fastening assembly 122. The second V-shaped clamp 120 also includes a clamping surface 130 for engaging the elongate shaft 102. Although the clamping surface 130 may be semi-circular in shape to correspond to the shape of the elongate shaft 102, it is preferred that the clamping surface 130 be a V-shaped clamping surface 130 as shown having a first substantially planar clamping surface 132 inclined relative to a second substantially planar clamping surface 134 by a predetermined angle. The predetermined angle may be any angle, but is preferably greater than 90 degrees and less than 180 degrees, and is most preferably greater than about 100 degrees. In the illustrated embodiment, the predetermined angle is about 110 degrees. Thus the predetermined angle of the second V-shaped clamp 120 is less than the predetermined angle of the first V-shaped clamp 118 in the illustrated embodiment, although it should be noted that the predetermined angles associated with the V-shaped clamps may be substantially identical or such that the predetermined angle associated with the first V-shaped clamp 118 is less than the predetermined angle associated with the second V-shaped clamp 120. Preferably, the first and second predetermined angles differ by greater than 5 degrees, and most preferably by more than 15 degrees.

Turning to FIGS. 3 and 5, the clamping surface 130 may include a plurality of raised ribs 136 which protrude outward from the clamping surface 130 in elongate strips. Preferably, the raised ribs 136 may be oriented substantially perpendicular to the longitudinal length of the elongate shaft 102 when the handle attachment assembly 100 is coupled to the elongate shaft 102, although they may be alternatively oriented without departing from the spirit and scope of the present invention. Preferably, the raised ribs 136 extend outward from the clamping surface 130 a predetermined distance 138 (See FIG. 5). In the illustrated embodiment, the predetermined distance is greater than about 0.5 millimeters, and is most preferably about 0.8 millimeters. Although raised ribs 136 are illustrated and described only for the clamping surface 130 of the second V-shaped clamp 120, it should be noted that the clamping surface 124 of the first V-shaped clamp 118 may also include one or more raised ribs. Alternatively, the raised ribs 136 may be located on the first V-shaped clamp 118 and not on the second V-shaped clamp 120.

Referring to FIG. 3, the fastening assembly 122 may include a first threaded fastener 140 and a second threaded fastener 142 which are rotateable to adjust a distance separating the first and second V-shaped clamps 118 and 120. The threaded fasteners 140 and 142 may engage a pair of nuts 141 and 143 held in place by a pair of cooperatively shaped recesses 144 and 146 in the first V-shaped clamp 118. Preferably, the recesses 144 and 146 are of sufficient length so as to extend past the distal ends of the threaded fasteners 140 and 142 thereby protecting the user from scraping their hand against the distal ends of the threaded fasteners 140 and 142. A structural web 152 may extend between the two recesses 144 and 146 and between the two support arms 116, the web 152 extending at the same height or higher than the distal ends of the recesses 144 and 146 to provide further protection to the hand of the user from the distal ends of the threaded fasteners 140 and 142 and also from the distal ends of the recesses 144 and 146 themselves.

Figure 4:
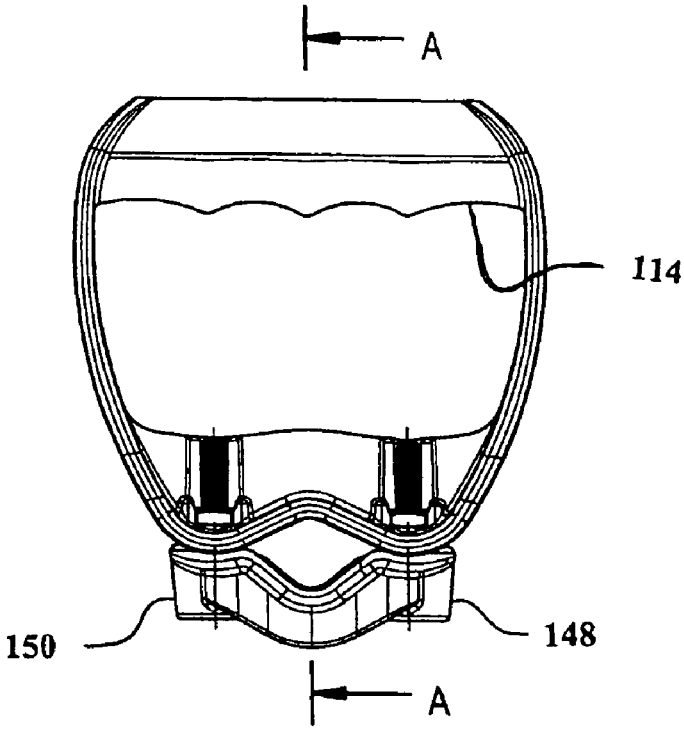
FIG. 4 is a front elevation view of the handle attachment assembly of FIG. 2.
Figure 8:
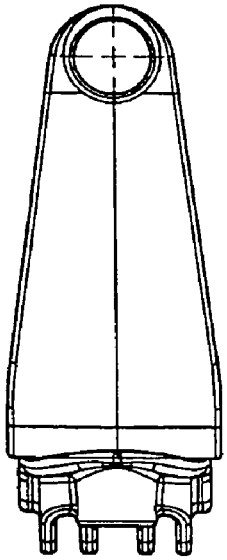
FIG. 8 is a side view of the handle attachment assembly of FIG. 4.
Figure 7:
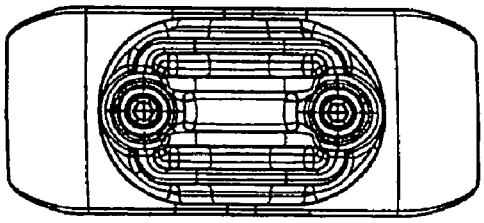
FIG. 7 is a bottom view of the handle attachment assembly of FIG. 4.

Referring to FIGS. 3 and 4, similarly, the second V-shaped clamp 120 also includes recesses 148 and 150 for receiving the proximal ends of the threaded fasteners 140 and 142 to protect the proximal ends of the threaded fasteners 140 and 142 from injuring the user or damaging property during use. Although the illustrated and described fastening assembly 122 uses threaded fasteners for selectively adjusting the distance between the first and second V-shaped clamps, it should be noted that other fastening assemblies are within the scope of the present invention, a few suitable example being screw, clip, and strapping based fastening assemblies.

Referring to FIGS. 3 and 9, the attachment of the handle attachment assembly 100 to the elongate shaft 102 will now be described. The first and second V-shaped clamps 118 and 120 are placed on opposite sides of the elongate shaft 102 from one another. The threaded fasteners 140 and 142 are rotated to drive the V-shaped clamps 118 and 120 toward one another, resulting in the elongate shaft 102 being compressed between the V-shaped clamps 118 and 120. Due to the V-shape configuration of the clamps 118 and 120 and due to the raised ribs 136, the elongate shaft 102 is engaged at a plurality of pressure points 154. Inasmuch as the clamping pressure is focused at these pressure points 154, deformation of the elongate shaft 102 occurs, thereby increasing the holding power of the handle attachment assembly 100 and its ability to resist slipping once attached to the elongate shaft 102 and torqued upon during use. The pressure points 154 are oriented in a pair of parallel lines oriented inline with the longitudinal axis of the elongate shaft. If the first V-shaped clamp does not utilize raised ribs as is the case for the illustrated embodiment, then the first V-shaped clamp 118 engages the elongate shaft 102 in two linear lines oriented inline with the longitudinal axis of the elongate shaft 102. Note in FIG. 9 that the threaded fasteners 140 and 142 are positioned in recesses 144, 146, 148, and 150 such that the user and surrounding property are protected from injury or damage during use of the handle attachment assembly 100.

Figure 10:
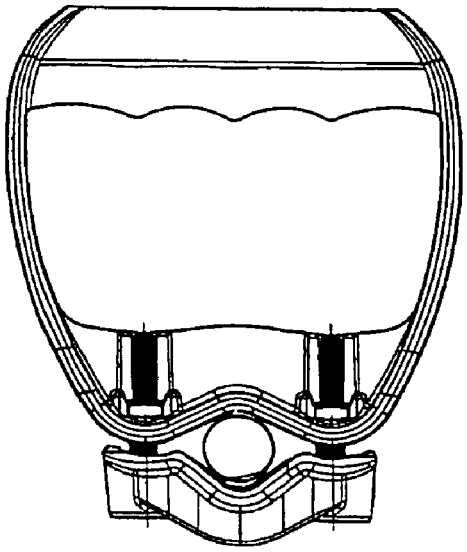
FIG. 10 is a front elevation view of the handle attachment assembly of FIG. 4 showing the handle attachment assembly removably coupled to a small diameter elongate shaft.

Turning now to FIGS. 9 and 10, it can be seen that clamp assembly is able to accommodate a large range of diameters of elongate shafts 102. In the illustrated embodiment, the clamp assembly 110 is able to accommodate elongate shaft 102 diameters of between about 2 centimeters to about 4.5 centimeters, though it should be apparent that other diameter ranges are within the spirit and scope of the present invention.

The handle attachment assembly 100 may be made from any rigid or semi-rigid material, a few suitable examples being wood, plastic, fiberglass, aluminium, steel, and/or alloys.

Advantages

A handle attachment assembly formed in accordance with the present invention provides one or more of the following advantages over previously developed handle attachment assemblies:

(a) The handle attachment assembly may be used to reduce the need to bend while performing a variety of tasks when using tools with elongate shafts both indoors or out;

(b) The handle attachment assembly may be used with a wide variety of different diameters of shafts;

(c) The handle attachment assembly may provide increased shaft holding power through using V-shaped clamps and/or pressure point clamping contact to the elongate shaft;

(d) The handle attachment assembly may be provided with recesses for guarding clamp fasteners used, thereby preventing or reducing injury to the user or damage to surrounding property during use;

(e) less expensive to manufacture; and (f) simpler to operate.

Variations

Throughout the description of this specification, the word "comprise" and variations of that word such as "comprising" and "comprises", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The invention claimed is:

1. A handle attachment assembly for removably attaching a handle to an elongate shaft having a proximal end and a distal end, the handle attachment assembly comprising:

a hand grip adapted to be gripped and held by a user;

a clamp assembly coupled to the hand grip for removably attaching the hand grip to the elongate shaft between the proximal end and the distal end of the elongate shaft, the clamp assembly being attachable to the elongate shaft;

one or more fasteners, each fastener having a proximal end and a distal end; and one or more elongated housings in the clamp assembly, wherein each of the one or more elongated housings extends by a first length from a surface portion of the clamp assembly facing the hand grip, each of the elongated housings extending toward the hand grip and each of the one or more elongated housings configured to receive one of the one or more fasteners, the first length being at least equal to a second length of the fastener extending from the surface portion such that the entire distal end of the fastener is at least partially enclosed within the elongated housing to impede injury from contact with the distal end of the fastener when the handle attachment assembly is coupled to the elongate shaft.

2. The handle attachment assembly as claimed in claim 1, wherein, the clamp assembly includes a first V-shaped clamp and a second V-shaped clamp, and each of the one or more fasteners is configured to drive the first V-shaped clamp toward the second V-shaped clamp to removably clamp the elongate shaft between the first and second V-shaped clamps.

3. The handle attachment assembly of claim 2, wherein the second V-shaped clamp includes one or more raised ribs protruding outward from a clamping surface of the second V-shaped clamp.

4. The handle attachment assembly of claim 3, wherein the one or more raised ribs protruding outward from the clamping surface of the second V-shaped clamp are oriented substantially perpendicular to a longitudinal length of the elongate shaft when the handle attachment assembly is coupled to the elongate shaft.

5. The handle attachment assembly of claim 4, wherein the one or more raised ribs protrude outward from the clamping surface of the second V-shaped clamp greater than 0.5 millimeters.

6. The handle attachment assembly of claim 2, wherein the first V-shaped clamp includes a clamping surface for engaging the elongate shaft, wherein the clamping surface is comprised of a first planar clamping surface and a second planar clamping surface, and wherein the first planar clamping surface is oriented greater than 90 degrees from the second planar clamping surface.

7. The handle attachment assembly of claim 1, wherein the hand grip is attached to the clamp assembly such that when the clamp assembly is removably coupled to the elongate shaft, the hand grip extends greater than 15 centimeters from the elongate shaft.

8. The handle attachment assembly of claim 1, wherein the hand grip is attached to the clamp assembly such that when the clamp assembly is removably coupled to the elongate shaft, the hand grip is oriented perpendicular to the elongate shaft.

9. The handle attachment assembly of claim 1, wherein, each of the one or more fasteners is a threaded fastener, and each of the one or more fasteners is rotatable to tighten or loosen the clamp assembly about the elongate shaft.

10. The handle attachment assembly of claim 2, wherein the second V-shaped clamp includes a clamping surface for engaging the elongate shaft, wherein the second V-shaped clamp assembly engages the elongate shaft at a plurality of pressure points.

11. The handle attachment assembly of claim 1, wherein the clamp assembly is adapted to couple to elongate shafts having diameters between about 2 centimeters and about 4 centimeters.

12. The handle attachment assembly of claim 1, wherein the hand grip has a diameter of greater than 2 centimeters and includes a plurality of finger indentations each adapted to receive a finger of the user.

13. The handle attachment assembly of claim 2, wherein the first V-shaped clamp has a first clamping surface and a second clamping surface inclined from one another by a first predetermined angle, wherein the second V-shaped clamp has a first clamping surface and a second clamping inclined from one another by a second predetermined angle, wherein the first predetermined angle is different than the second predetermined angle by more than about five degrees.

14. The handle attachment assembly of claim 7, wherein the hand grip is attached to the clamp assembly such that when the clamp assembly is removably coupled to the elongate shaft, the hand grip is oriented perpendicular to the elongate shaft.

15. The handle attachment assembly of claim 2, wherein the first V-shaped clamp is integrally formed with the hand grip.

16. The handle attachment assembly of claim 1, wherein a structural web extends between any two or more of the elongated housings.

17. The handle attachment assembly of claim 1, wherein a structural web extends between two support arms which couple the hand grip to the clamp assembly.

18. The handle attachment assembly of claim 16, wherein the structural web extends between any two or more of the elongated housings and between two support arms which couple the hand grip to the clamp assembly.

19. The handle attachment assembly of claim 1, wherein each of the one or more elongated housings are configured to surround one of the one or more fasteners between the proximal end of the fastener and the distal end of the fastener.

20. The handle attachment assembly of claim 1, wherein a base section of each of the elongated housings has side walls configured to receive the sides of a nut configured to engage in threaded engagement with one of the one or more fasteners, and wherein the side walls are configured to prevent a rotation of the nut.

* * * * *